US008147318B2

(12) United States Patent
Krise et al.

(10) Patent No.: US 8,147,318 B2
(45) Date of Patent: Apr. 3, 2012

(54) ROLL 21 GAME

(75) Inventors: David A. Krise, Spokane, WA (US); Donald L. Evans, Spokane, WA (US); Justin P. Mager, Cheney, WA (US); Luke M. Kuhn, Spokane, WA (US)

(73) Assignee: DigiDeal Corporation, Spokane Valley, WA (US)

( * ) Notice: Subject to any disclaimer, the term of this patent is extended or adjusted under 35 U.S.C. 154(b) by 349 days.

(21) Appl. No.: 12/434,830

(22) Filed: May 4, 2009

(65) Prior Publication Data

US 2010/0279761 A1 Nov. 4, 2010

(51) Int. Cl.
*A63F 9/24* (2006.01)

(52) U.S. Cl. ..... 463/22; 273/146

(58) Field of Classification Search ..... 463/15–26
See application file for complete search history.

(56) References Cited

U.S. PATENT DOCUMENTS 4,380,334 A 4/1983 Minkoff et al.
4,531,187 A 7/1985 Uhland
4,614,342 A 9/1986 Takashima
4,636,951 A 1/1987 Harlick
4,760,527 A 7/1988 Sidley
4,813,675 A 3/1989 Greenwood
4,926,327 A 5/1990 Sidley
5,022,653 A 6/1991 Suttle et al.
5,033,744 A 7/1991 Bridgeman et al.
5,046,736 A 9/1991 Bridgeman et al.
5,098,107 A 3/1992 Boylan et al.
5,141,234 A 8/1992 Boylan et al.
5,224,706 A 7/1993 Bridgeman et al.
5,242,163 A 9/1993 Fulton
5,255,915 A 10/1993 Miller
5,332,219 A 7/1994 Marnell, II et al.
5,377,973 A 1/1995 Jones
5,377,993 A 1/1995 Josephs
5,393,057 A 2/1995 Marnell, II
(Continued)

OTHER PUBLICATIONS

U.S. Appl. No. 11/396,005, filed 2006, Sines et al.

(Continued)

*Primary Examiner* — Ha Tran T Nguyen
*Assistant Examiner* — Vongsavanh Sengdara
(74) *Attorney, Agent, or Firm* — Mark Farrell Patent Law PC

(57) ABSTRACT

A Roll 21 game is described. In one implementation, an example game method for one or more players includes accepting a bet from each of the one or more players, and selecting one of the players to be the shooter to roll two dice for all the players. Each six-sided die has the numbers 1, 2, 3, 4, 5, and 6 distributed on respective sides. The shooter rolls the two dice in multiple dice rolls until a cumulative total of the rolls equals or exceeds 17 or, until all players have stood and no bonus bets have been placed that require further accumulation of dice points. After each roll, each player may stand at the current cumulative total of the dice rolls. Then, when the cumulative total of the rolls equals or exceeds 17 (unless, e.g., all players have previously stood), the shooter rolls a host die to obtain a host total. The single six-sided host die has the numbers 17, 18, 19, and 21 distributed on four of the six sides and the word "Bust" is distributed on two of the six sides. The cumulative total of each player is compared with the host total to determine whether each player's bet receives a payout, for example a 1:1 payout on the initial bet. Bonus bet options are also available.

19 Claims, 1 Drawing Sheet

U.S. PATENT DOCUMENTS 5,407,199 A 4/1995 Gumina
5,423,551 A 6/1995 Stavinsky
5,496,032 A 3/1996 Okada
5,511,781 A 4/1996 Wood et al.
5,531,440 A 7/1996 Dabrowski et al.
5,531,448 A 7/1996 Moody
5,586,766 A 12/1996 Forte et al.
5,586,936 A 12/1996 Bennett et al.
5,613,912 A 3/1997 Slater
5,630,586 A 5/1997 Lowden
5,636,843 A 6/1997 Roberts
5,651,548 A 7/1997 French et al.
5,655,966 A 8/1997 Werdin
5,669,817 A 9/1997 Tarantino
5,674,128 A 10/1997 Holch et al.
5,687,968 A 11/1997 Tarantino
5,735,742 A 4/1998 French
5,743,800 A 4/1998 Huard et al.
5,766,076 A 6/1998 Pease et al.
5,770,533 A 6/1998 Franchi
5,779,546 A 7/1998 Meissner et al.
5,788,230 A 8/1998 Krise et al.
5,788,574 A 8/1998 Omstein et al.
5,803,808 A 9/1998 Strisower
5,831,527 A 11/1998 Jones, II et al.
5,839,960 A 11/1998 Parra et al.
5,845,907 A 12/1998 Wells
5,868,392 A 2/1999 Kraft
5,879,233 A 3/1999 Stupero
5,909,876 A 6/1999 Brown
5,918,881 A * 7/1999 Kirby ..... 273/146
5,919,090 A 7/1999 Mothwurf
5,934,672 A 8/1999 Sines et al.
5,944,315 A 8/1999 Mostashari
5,944,316 A 8/1999 Hernandez
5,951,397 A 9/1999 Dickinson
5,934,998 A 10/1999 Forte et al.
6,010,404 A 1/2000 Walker et al.
6,062,563 A * 5/2000 de Keller ..... 273/274
6,093,101 A 7/2000 Mourad
6,099,408 A 8/2000 Schneider et al.
6,158,741 A 12/2000 Koelling
6,165,069 A 12/2000 Sines et al.
6,173,955 B1 * 1/2001 Perrie et al. ..... 273/146
6,186,895 B1 2/2001 Oliver
6,200,218 B1 3/2001 Lindsay
6,203,008 B1 3/2001 Krise et al.
6,203,009 B1 3/2001 Sines et al.
6,217,447 B1 4/2001 Lofink et al.
6,270,404 B2 8/2001 Sines et al.
6,419,225 B2 7/2002 Sines et al.
6,419,226 B2 7/2002 Krise et al.
6,481,718 B2 11/2002 Koelling
6,619,659 B2 9/2003 Krise et al.
6,641,137 B2 11/2003 Sines et al.
6,651,985 B2 11/2003 Sines et al.
6,722,974 B2 4/2004 Sines et al.
6,896,259 B2 5/2005 Sines et al.
7,048,629 B2 5/2006 Sines et al.
7,255,642 B2 8/2007 Sines et al.
2001/0030393 A1 * 10/2001 Flannery ..... 273/274
2002/0036380 A1 * 3/2002 Perrie et al. ..... 273/146
2004/0152498 A1 * 8/2004 Kaminkow et al. ..... 463/16

OTHER PUBLICATIONS

U.S. Appl. No. 11/397,155, filed 2006, Sines et al.
U.S. Appl. No. 11/404,955, filed 2006, Sines et al.
U.S. Appl. No. 11/404,952, filed 2007, Kuhn et al.
U.S. Appl. No. 11/505,748, filed 2008, Kuhn et al.
U.S. Appl. No. 11/100,795, filed 2006, Sines et al.
U.S. Appl. No. 11/591,144, filed 2007, Kuhn et al.
U.S. Appl. No. 11/590,954, filed 2007, Kuhn et al.
U.S. Appl. No. 11/591,145, filed 2007, Kuhn et al.
U.S. Appl. No. 11/591,072, filed 2006, Kuhn et al.
U.S. Appl. No. 11/642,404, filed 2006, Kuhn et al.
U.S. Appl. No. 11/642,580, filed 2006, Kuhn et al.
U.S. Appl. No. 12/072,020, filed 2008, Kuhn et al.
U.S. Appl. No. 12/077,074, filed 2008, Sines et al.
U.S. Appl. No. 12/072,028, filed 2008, Sines et al.
U.S. Appl. No. 12/077,078, filed 2008, Sines et al.
U.S. Appl. No. 12/077,080, filed 2008, Sines et al.
U.S. Appl. No. 10/858,160, filed 2005, Sines et al.
U.S. Appl. No. 11/055,589, filed 2005, Sines et al.
U.S. Appl. No. 12/176,248, filed 2008, Kuhn et al.
U.S. Appl. No. 12/192,751, filed 2008, Kuhn et al.
U.S. Appl. No. 12/248,891, filed 2008, Kuhn et al.
U.S. Appl. No. 12/251,875, filed 2008, Krise et al.
U.S. Appl. No. 12/260,989, filed 2008, Kuhn et al.
U.S. Appl. No. 12/268,398, filed 2008, Chatellier, et al.
U.S. Appl. No. 12/269,029, filed 2008, Kuhn et al.
U.S. Appl. No. 12/323,478, filed 2008, Kuhn et al.
U.S. Appl. No. 12/336,672, filed 2008, Kuhn et al.
U.S. Appl. No. 12/353,262, filed 2009, Kuhn et al.
U.S. Appl. No. 12/353,263, filed 2009, Kuhn et al.
U.S. Appl. No. 12/394,040, filed 2009, Kuhn et al.

* cited by examiner

ROLL 21 GAME

BACKGROUND

Blackjack, also known as "twenty-one," "Vingt-et-un" (French), or "Pontoon" is a popular and predominant card game for gambling in card rooms and casinos in many parts of the world. Blackjack is the most widely played casino banking game in the world. Some countries and legal jurisdictions do not allow the use of playing cards, however. To play a Blackjack-like game in some parts of the world, e.g., where dice are used instead of playing cards, or just to add variety for patrons who like Blackjack, what is needed is a Blackjack-like game based on dice.

SUMMARY

A Roll 21 game is described. In one implementation, an example game method for one or more players includes accepting a bet from each of the one or more players, and selecting one of the players to be the shooter to roll two dice for all the players. Each six-sided die has the numbers 1, 2, 3, 4, 5, and 6 distributed on respective sides. The shooter rolls the two dice in multiple dice rolls until a cumulative total of the rolls equals or exceeds 17 or, until all players have stood and no bonus bets have been placed that require further accumulation of dice points. After each roll, each player may stand at the current cumulative total of the dice rolls. Then, when the cumulative total of the rolls equals or exceeds 17 (unless, e.g., all players have previously stood), the shooter rolls a host die to obtain a host total. The single six-sided host die has the numbers 17, 18, 19, and 21 distributed on four of the six sides and the word "Bust" is distributed on two of the six sides. The cumulative total of each player is compared with the host total to determine whether each player's bet receives a payout, for example, a 1:1 payout on the initial bet.

Bonus bet options are also available, such as a Roll 21 Jackpot bet, which wins when the cumulative total equals 21 in two or more rolls; a Three 7's bet, which wins when three consecutive 7's are rolled and loses as soon as a 7 is not rolled; a Bust in Two Rolls bet, which wins when the player rolling the two dice busts in two rolls (because the cumulative total equals 22, 23, or 24); and a Tie bet, which wins when the final cumulative total and the host total are the same number. Each of these bonus bets has a respective payout, described below.

The Roll 21 game may also be implemented on an electronic game table or machine, with virtual game pieces.

This summary section is not intended to give a full description of the Roll 21 Game, or to provide a list of features and elements. A detailed description of example embodiments of the electronic gaming system follows.

DETAILED DESCRIPTION

Overview

Figure 1:
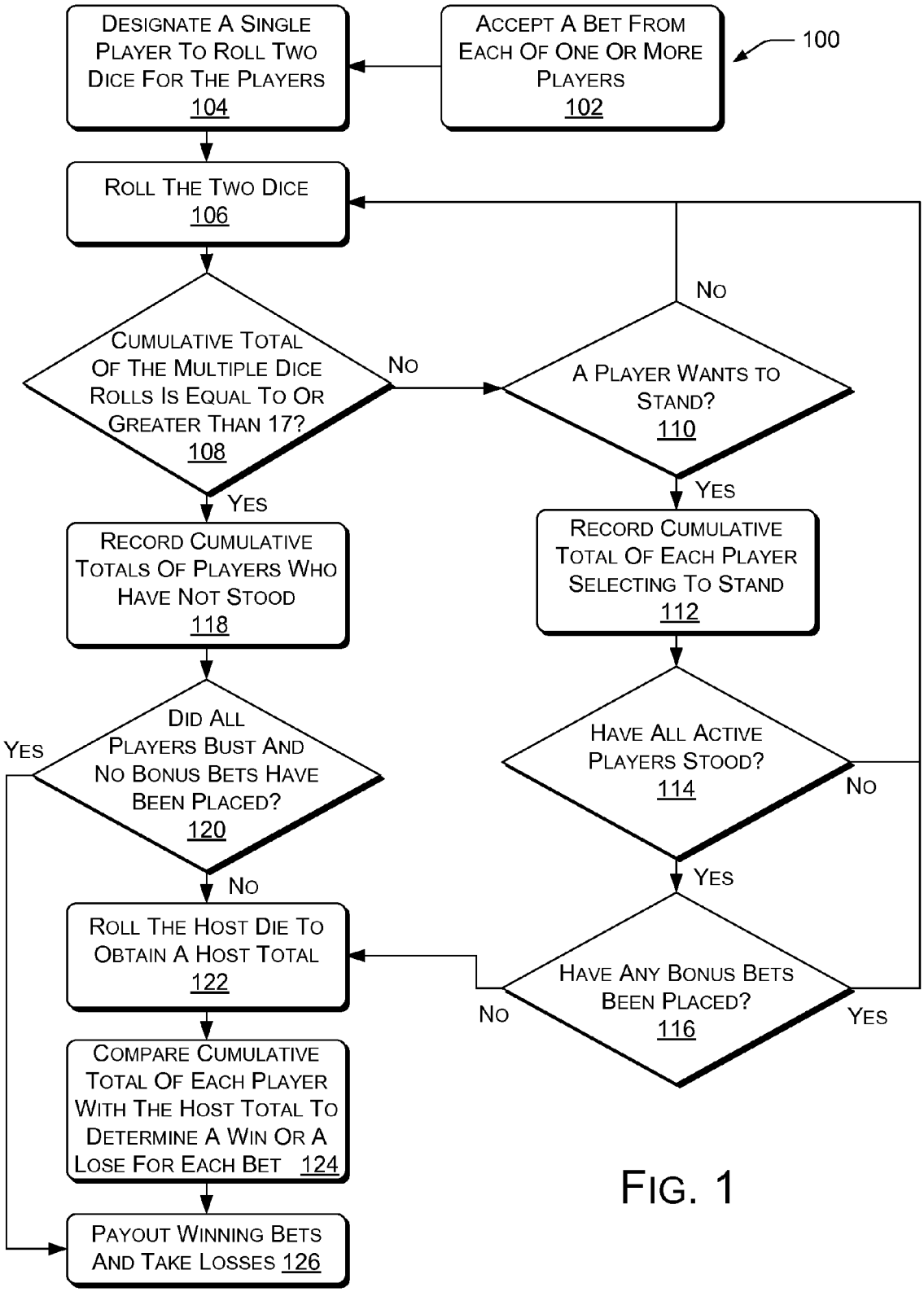
FIG. 1 is a flow diagram of an exemplary method of playing a Roll 21 game.

This disclosure describes a Roll 21 Game. Roll 21 is a dice-based table game with play action and bets similar to but not exactly the same as conventional Blackjack or "21." The object of the game is for the player to accrue a total closer to 21 than a host, without going over 21. The game can also offer Blackjack-like features, such as, standing and doubling down. Two standard six-sided dice may be rolled to determine a player's "hand: total, which is compared to the roll outcome of a single six-sided host die to determine wins or losses. The host die has a special construction.

Example Game Play of Roll 21

In one implementation, players place at least one bet, a "main bet," in order to play. Other optional bonus bets are available. In one scenario, a single player is selected to be the shooter for all the players. The designated shooter shakes two conventional dice, the "player dice," in multiple rolls until a cumulative total of 17 is reached or exceeded (unless all the players have previously stood and no special bonus bets have been placed that depend on a further accumulation of dice points). Then the shooter subsequently rolls a specially constructed "host" die, once, to obtain a host total that is compared with each player's cumulative total to determine wins and losses.

Each player has the option to "stand" after any roll. Players may also have the option of increasing their wager by doubling their main bet. In one implementation, this additional doubling of the bet is only offered immediately after the first roll of the two "player" dice. The designated dice shooter, even when deciding to "stand" early, continues to roll the player dice, if needed, and stops on the roll that yields 17 or higher unless all the players have previously stood and no bonus bets have been placed. Once 17 or higher is rolled without busting (going over 21), the designated dice shooter may roll the single, six-sided, host die, marked on respective sides, "17," "18," "19," "21," "Bust," and "Bust" (there is no "20"), in order to obtain the "host total," but the shooter rolls the host die only if all the players have not busted and/or at least one bonus bet has been placed. At the beginning of each new game the designated shooter position may move to the next available player position to the left of the previous shooter.

Table (1) below shows example bets, bonus bets, and respective payouts.

TABLE (1)

| Bets and their Respective Payouts |
|---|
| MAIN BET |
| For the main bet, the player is betting that the total rolled by the shooter will be closer to 21, without going over, than the host die outcome or if the player stands at a total of 17 or below, that the host will roll a Bust (33.3% chance that the host will roll a Bust).<br>Payout:<br>The main bet pays 1 to 1<br>A tie is always a push for the Main Bet. |
| Doubling the Main Bet |
| Doubling the Main Bet is an additional bet only offered immediately after the first roll of the player dice. This bet doubles the main bet.<br>Payout:<br>Pays 1 to 1 with respect to the doubled main bet. |
| BONUS BETS |
| Roll 21 Jackpot Bet |
| The player bets that the total rolled by the shooter will be 21 in two or more rolls.<br>Payout:<br>2 Rolls . . . Pays 15 to 1<br>3 Rolls . . . Pays 3 to 1<br>4 Rolls . . . Pays 15 to 1<br>5 Rolls . . . Pays 50 to 1<br>6 or more Rolls . . . Pays 500 to 1 |
| Three 7's Bet |
| The player is betting that three consecutive 7's will be rolled. The bet loses as soon as a seven is not rolled.<br>Payout:<br>Three 7's . . . Pays 200 to 1 |

TABLE (1)-continued

| Bets and their Respective Payouts |
|---|
| Bust In Two Rolls Bet |
| The player is betting that the shooter will bust in two rolls with a total of 22, 23 or 24.<br>Payout:<br>Bust in two rolls . . . Pays 80 to 1 |
| Tie Bet |
| The player is betting that the shooter's total and the host's total will be the same.<br>Payout:<br>Tie . . . Pays 9 to 1 |

Variations

Doubling Down

In one variation, a player is allowed to "double down." In one implementation, this means that the player has an option to double the original main bet in exchange for receiving the numerical outcome of only one roll or multiple rolls of the two player dice toward the player's cumulative total.

Splitting a Pair

In another implementation (for example, as executed by an electronic game table), a player may "split a pair" when the numbers that come up on the two player dice are the same. To split a pair, the electronic game table may split or reproduce images of virtual dice to show two lines of game action and two corresponding cumulative totals for that player, while the player doubles the original main bet. The player may "stand" at a different number of subsequent dice rolls for each of the two cumulative totals as the game play progresses.

Example Method

FIG. 1 shows an exemplary method 100 of playing a version of the Roll 21 game. In the flow diagram of FIG. 1, the operations are summarized in individual blocks. The example method 100 may also be performed by hardware, or combinations of hardware, software, firmware, etc., such as by an electronic game table or machine.

At block 102, a bet is accepted from each of one or more players.

At block 104, a single player is designated to roll two dice for the one or more players. Each of the two dice has a typical six-sided die construction having the numbers 1, 2, 3, 4, 5, and 6 distributed on the six sides.

At block 106, the two dice are rolled and the numerical results of each die are accumulated into a cumulative total.

At block 108, the game method determines whether the cumulative total of the multiple dice rolls is equal to or greater than 17.

At block 110, when the cumulative total is not yet equal to or greater than 17, the game method determines whether a player wants to exercise the option of standing at the present cumulative total. If no players want to stand then the method loops back to block 106 to roll the two dice again.

At block 112, when one or more of the players want to stand, each standing player's cumulative total is recorded.

At block 114, the game method determines whether all active players have stood. If all active players have not stood, then the method loops back to block 106, to roll the two dice again.

At block 116, if all active players have stood, then the game method determines if any bonus bets have been placed. If at least one bonus bet has been placed, then the method loops back to block 106, to roll the two dice again.

At block 118, when the cumulative total at block 108 is equal to or greater than 17 after the previous roll of the two dice, the cumulative total of each remaining player who has not stood yet is then recorded.

At block 120, after the cumulative total has reached or surpassed 17, the game method determines whether all the players have busted while no bonus bets were placed.

At block 122, the cumulative total now being 17 or more, if at least one of the players did not bust and/or at least one bonus bet was placed, then a single six-sided host die is rolled to obtain a host total. The host die has six sides with the numbers 17, 18, 19, and 21 distributed on four of the sides and the word BUST distributed on two of the sides.

The host die is also rolled immediately if, before the cumulative total equaled or surpassed 17, all active players already stood (at block 114) while no bonus bets were placed (at block 116).

At block 124, the cumulative total of each player is compared with the host total to determine a win or lose for each bet.

At block 126, each winning bet is paid out according to a respective payout, i.e., according to a payout schedule or payout chart, and losses are also taken. If all players previously busted and no bonus bets were placed at block 120, the losses are taken directly at block 126 without rolling the host die at block 122.

Conclusion

Although exemplary systems have been described in language specific to structural features and/or methodological acts, it is to be understood that the subject matter defined in the appended claims is not necessarily limited to the specific features or acts described. Rather, the specific features and acts are disclosed as exemplary forms of implementing the claimed systems, methods, and structures.

The invention claimed is:

1. A system, for one or more players, comprising:

a processor;

a tangible data storage medium;

instructions storable on the tangible data storage medium and executable on the processor for:

accepting a bet from each of the one or more players;

selecting a single player to roll two dice for the one or more players, wherein each of the two dice comprise a six-sided die having the numbers 1, 2, 3, 4, 5, and 6 distributed on the six sides;

rolling the two dice in multiple dice rolls until a cumulative total of the multiple dice rolls is equal to or greater than 17, or until the one or more players have stood and a bonus bet that depends on a cumulative total equal to or greater than 17 has not been placed;

after each roll of the two dice, accepting from any of the one or more players an option to stand at a current cumulative total;

rolling a single six-sided host die to obtain a host total, wherein the host die comprises a six-sided die having the numbers 17, 18, 19, and 21 distributed on four of the sides and the word Bust distributed on two of the sides; and comparing the cumulative total of each of the one or more players with the host total to determine for each bet, whether to award a payout for the bet.

2. The system as recited in claim 1, wherein each of the one or more players with a cumulative total greater than 21 is awarded no payout.

3. The system as recited in claim 1, wherein when a cumulative total of a player of the one or more players and the host total are each less than or equal to 21 and the cumulative total of the player is closer to 21 than the host total, then awarding a 1:1 payout to the bet of the player, wherein the 1:1 payout is a return of the bet to the player plus an amount equal to the bet of the player.

4. The system game as recited in claim 1, wherein when a cumulative total of a player of the one or more players is less than or equal to 21 and the host die rolls a Bust, then awarding a 1:1 payout to the bet of the player, wherein the 1:1 payout is a return of the bet to the player plus an amount equal to the bet of the player.

5. The system as recited in claim 1, wherein when a cumulative total of a player of the one or more players and the host total are less than or equal to 21 and the cumulative total of the player and the host total are equal, then pushing the bet of the player, wherein the pushing comprises returning the bet of the player to the player.

6. The system as recited in claim 1, further comprising, after the first roll of the two dice, accepting from a player of the one or more players an option to double the bet of the player.

7. The system as recited in claim 1, wherein when the single player selected to roll the two dice stands after a roll of the two dice, the single player continues to roll the two dice in subsequent dice rolls for the other players until a cumulative total of the multiple dice rolls is equal to or greater than 17.

8. The system as recited in claim 1, further comprising, when two or more players play the game method, varying the player who rolls the two dice and the host die, such that a first player rolls the two dice and a second player rolls the host die.

9. The system as recited in claim 1, wherein when two or more players play, the player to the left of the previous player to roll the two dice is selected to currently roll the two dice.

10. The system as recited in claim 1, further comprising accepting a Roll 21 Jackpot bet from a player, wherein the Roll 21 Jackpot bet wins when the cumulative total equals 21 in two or more rolls; and wherein when 21 is rolled in 2 rolls, the payout is 15:1;

wherein when 21 is rolled in 3 rolls, the payout is 3:1;

wherein when 21 is rolled in 4 rolls, the payout is 15:1;

wherein when 21 is rolled in 5 rolls, the payout is 50:1; and wherein when 21 is rolled in 6 or more rolls, the payout is 500:1.

11. The system game as recited in claim 1, further comprising accepting a Three 7's bet from a player, wherein the Three 7's bet wins when three consecutive 7's are rolled and loses as soon as a 7 is not rolled; and wherein when three consecutive 7's are rolled, the payout is 200:1.

12. The system as recited in claim 1, further comprising accepting a Bust in Two Rolls bet from a player, wherein the Bust in Two Rolls bet wins when the player rolling the two dice busts in two rolls when the cumulative total equals 22, 23, or 24; and wherein when the player rolling the two dice busts in two rolls when the cumulative total equals 22, 23, or 24, the payout is 80:1.

13. The system as recited in claim 1, further comprising accepting a Tie bet from a player, wherein the Tie bet wins when the final cumulative total and the host total are the same number; and wherein when the final cumulative total and the host total are the same number, the payout is 9:1.

14. The system as recited in claim 1, further comprising receiving an option from a player of the one or more players for doubling down, wherein the doubling down comprises the player doubling the player's initial bet in exchange for receiving a numerical outcome of only one more roll of the two dice toward the player's cumulative total.

15. The system as recited in claim 1, further comprising receiving an option from a player of the one or more players for splitting a pair when a numerical outcome on each of the two dice are the same;

wherein the splitting a pair comprises maintaining two cumulative totals for the player, while the player doubles the player's initial bet; and wherein the player may stand at a different number of subsequent dice rolls for each cumulative total as subsequent dice rolls progress.

16. The system game method as recited in claim 1, further comprising a multiplayer electronic game table that includes a touch screen display for each player; and wherein the two dice and the host die are represented by virtual images of dice on the touch screen displays.

17. An electronic game table for one or more players, comprising:

a processor;

a memory;

a data storage medium;

game instructions storable on the data storage medium and executable on the processor, including logic for:

accepting a bet from each of the one or more players;

selecting a single player to roll two virtual dice for the one or more players, wherein each of the two virtual dice comprise a 3-D modeled six-sided die having the numbers 1, 2, 3, 4, 5, and 6 distributed on respective six sides;

rolling the two virtual dice in multiple dice rolls until a cumulative total of the multiple dice rolls is equal to or greater than 17, or until all players have stood and a bonus bet that depends on a cumulative total equal to or greater than 17 has not been placed;

after each roll of the two virtual dice, accepting from any of the one or more players an option to stand at a current cumulative total;

rolling a single six-sided virtual host die to obtain a host total, wherein the virtual host die comprises a 3-D modeled six-sided die having the numbers 17, 18, 19, and 21 distributed on four of the sides and the word Bust distributed on two of the sides; and comparing the cumulative total of each player with the host total to determine for each bet, whether to award a payout for the bet.

18. The electronic game table as recited in claim 17, wherein the logic enables reception of player input to designate when the two virtual dice or the virtual host die are to be rolled; and wherein after a predetermined time interval without the player input, the logic causes automatic execution of a roll of the two virtual dice or the virtual host die.

19. The electronic game table as recited in claim 17, wherein the logic causes to be presented, on at least one electronic display, a cumulative total of the accumulated points rolled on the two virtual dice across multiple rolls and a total rolled on the virtual host die;

wherein the logic automatically computes wins and losses of the bets based on the cumulative total of the two virtual dice and the total rolled on the virtual host die; and wherein the logic displays the wins and losses on at least one electronic display.

* * * * *